US009754564B2

(12) United States Patent
Knapp

(10) Patent No.: US 9,754,564 B2
(45) Date of Patent: Sep. 5, 2017

(54) STRINGED INSTRUMENT PICK

(71) Applicant: Jeff Andrew Knapp, Omaha, NE (US)

(72) Inventor: Jeff Andrew Knapp, Omaha, NE (US)

( * ) Notice: Subject to any disclaimer, the term of this patent is extended or adjusted under 35 U.S.C. 154(b) by 0 days.

(21) Appl. No.: 15/335,377

(22) Filed: Oct. 26, 2016

(65) Prior Publication Data

US 2017/0116969 A1 Apr. 27, 2017

Related U.S. Application Data

(60) Provisional application No. 62/246,974, filed on Oct. 27, 2015.

(51) Int. Cl.
*G10D 3/16* (2006.01)

(52) U.S. Cl.
CPC ..... *G10D 3/163* (2013.01)

(58) Field of Classification Search
CPC .... G10D 3/163; G10D 1/005; F21Y 2101/00; B32B 37/16
USPC ..... 84/320–322
See application file for complete search history.

(56) References Cited

U.S. PATENT DOCUMENTS 2,221,234 A * 11/1940 Frasier ..... G10D 3/163 84/322
6,118,058 A * 9/2000 Rowley ..... G10D 3/163 84/320

* cited by examiner

*Primary Examiner* — Kimberly Lockett
(74) *Attorney, Agent, or Firm* — Husch Blackwell LLP

(57) ABSTRACT

An improved stringed instrument pick having a two-piece configuration including a holding device having a finger hole associated therewith and a pick member selectively engageable with the holding device, the pick member having a first playing surface and a second playing surface joined together at a joinder edge so as to form a V-shaped configuration. The first and second playing surfaces include first and second prong members respectively for engaging corresponding slots associated with the holding device. The pick member is selectively engageable with the holding device such that a user can use a differently angled or sized pick member with the same holding device depending upon the particular stringed instrument being played and/or to achieve a particular style or sound. As such, the present pick provides multiple playing surfaces which can be utilized in a wide variety of different ways to play a particular stringed instrument.

22 Claims, 15 Drawing Sheets

STRINGED INSTRUMENT PICK

CROSS-REFERENCE TO RELATED APPLICATIONS

This application claims the benefit of U.S. Provisional Application No. 62/246,974, filed Oct. 27, 2015, which is hereby incorporated by reference in its entirety.

FIELD OF THE INVENTION

The present invention relates generally to picks. More specifically, the present invention is an improved pick for playing stringed instruments. Unlike traditional picks, the present invention does not need to be held by two fingers and instead wraps around the user's finger, enabling the user to utilize more fingers when playing. The present invention will cut down the distance between strings and provides broader playing surfaces, allowing users to play at much faster speeds.

BACKGROUND OF INVENTION

Traditional guitar picks are one dimensional and limit the user to a single playing surface, or point, which they may utilize when playing the instrument. In other words, the fine point, or edge, of the traditional guitar pick is the only striking surface suitable for playing the instrument. Additionally, because of the flat configuration of traditional guitar picks, playing high tempo songs may be difficult due to the transition from string to string. Moving the fine point or edge of the traditional guitar pick from string to string can be difficult for many users as it requires a great amount of hand speed and coordination. Therefore, there is clearly a need for an invention that improves upon the traditional guitar picks that are used today.

SUMMARY OF INVENTION

The present invention is an improved string instrument pick that comprises a V-shaped pick and holding device, which enables the pick to be fastened to the user's finger. The V-shaped configuration of the present invention will cut down the distance between the instrument's strings, allowing the user to play at much faster speeds. In addition to the fine point, the present invention provides multiple playing surfaces which can be utilized in a variety of ways to play the instrument. Further, because the present invention is wrapped around the user's finger, the user may use their remaining fingers to play the instrument. For example, traditional picks are generally held between the user's index finger and thumb, which reduces the number of fingers the user may utilize. Because the present invention is wrapped around a single finger of the user, his or her remaining fingers are free to strum or pluck at the strings when playing an instrument. Therefore, the present invention provides a more versatile and improved string instrument pick when compared to existing inventions.

All illustrations of the drawings are for the purpose of describing selected embodiments of the present invention and are not intended to limit the scope of the present invention.

DETAILED DESCRIPTION OF THE INVENTION

Figure 1:
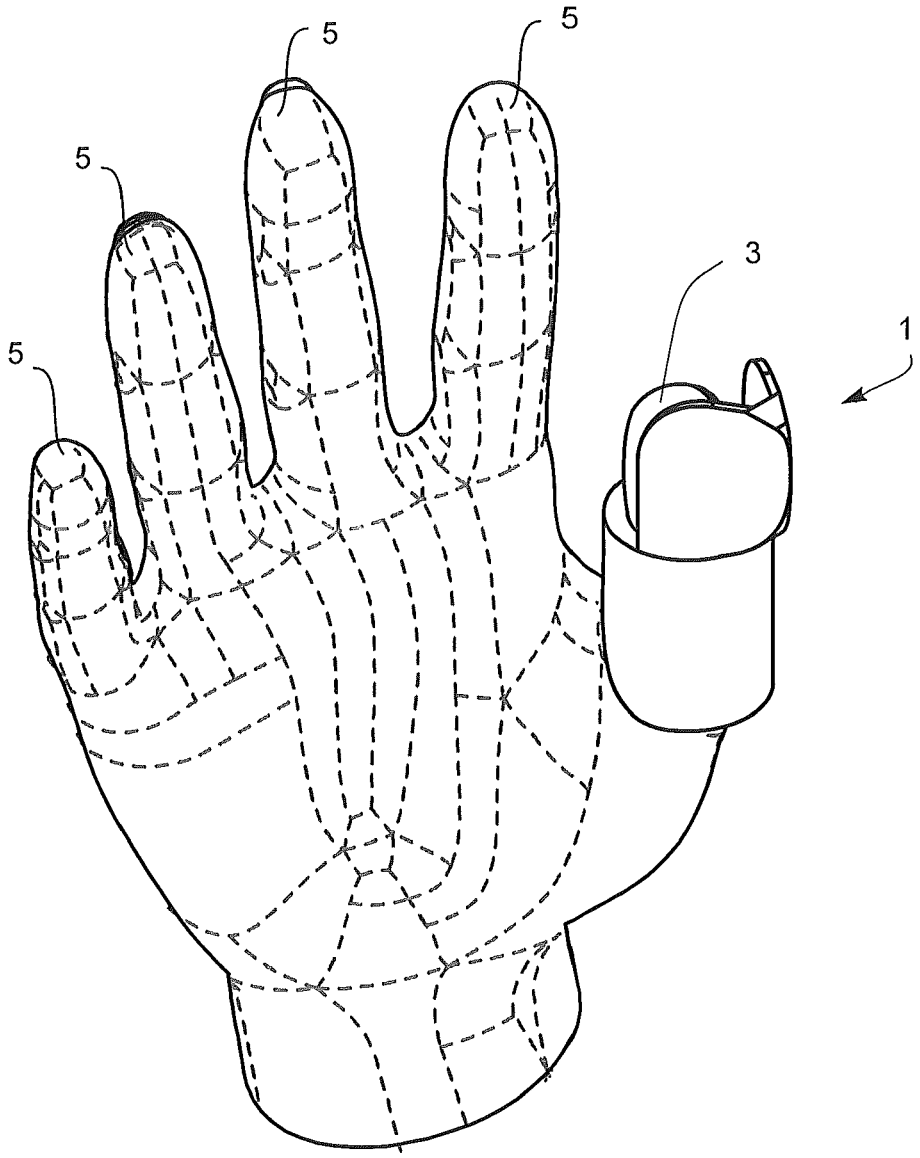
FIG. 1 is a perspective view of one embodiment of the present invention in operative position on a user's finger.

In referring to the drawings more particularly by reference numbers wherein like numerals refer to like parts, the numeral 1 in FIG. 1 illustrates a perspective view of the present improved stringed instrument pick constructed in accordance with the various teachings of the present invention. The stringed instrument pick 1 described below allows a musician to play a stringed instrument at faster speeds and with more comfort since it provides broader playing surfaces as compared to traditional picks which allows a user to cut down the distance between strings when playing. The pick 1 is worn on the finger of a musician, for example a thumb 3, as shown in FIG. 1. The pick 1 may alternatively be worn on any or all of the other fingers 5, or multiple picks 1 may be worn at the same time on multiple fingers, depending on a user's preferred playing style.

Figure 2:
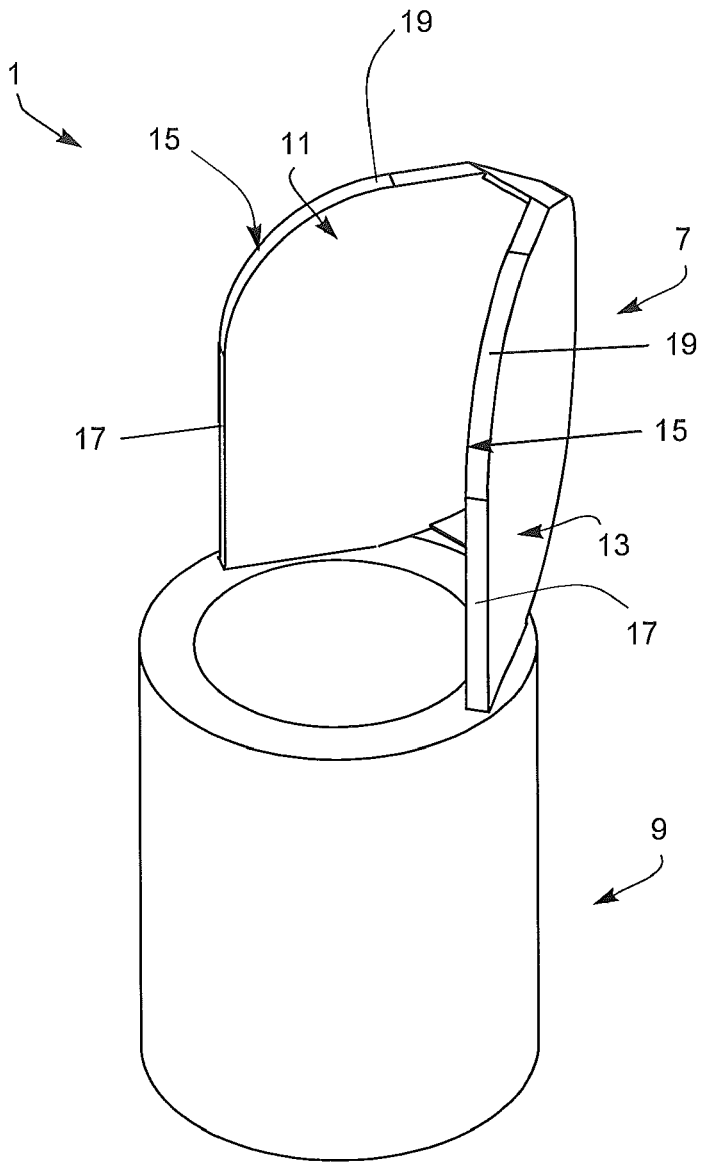
FIG. 2 is a perspective view of the present invention.
Figure 3:
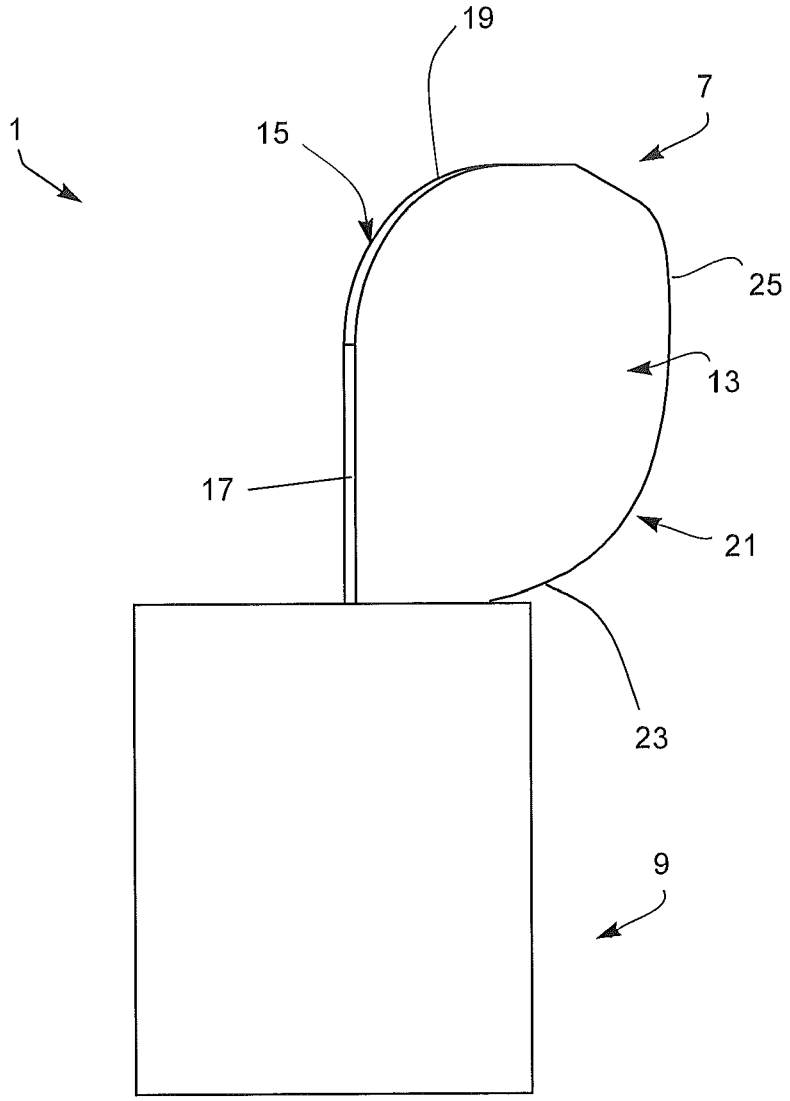
FIG. 3 is a right-side elevational view of FIG. 2.
Figure 4:
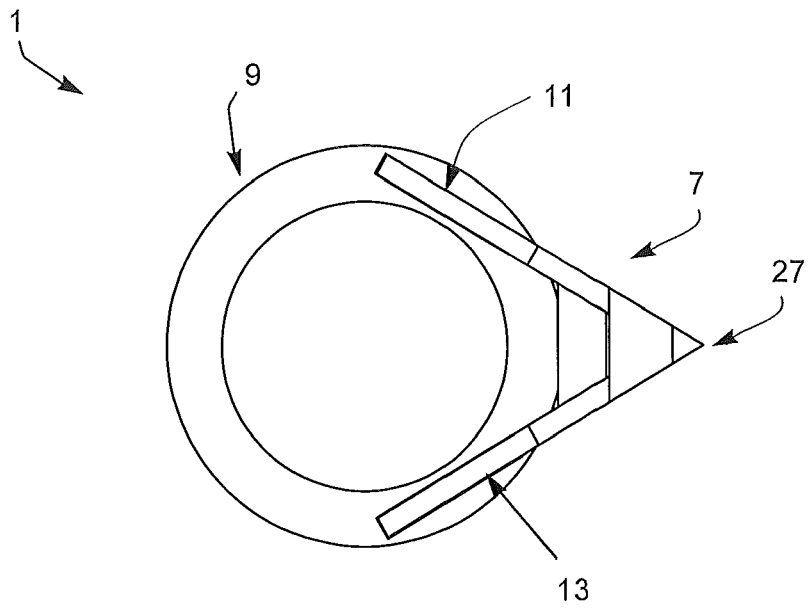
FIG. 4 is a top plan view of FIG. 2.
Figure 5:
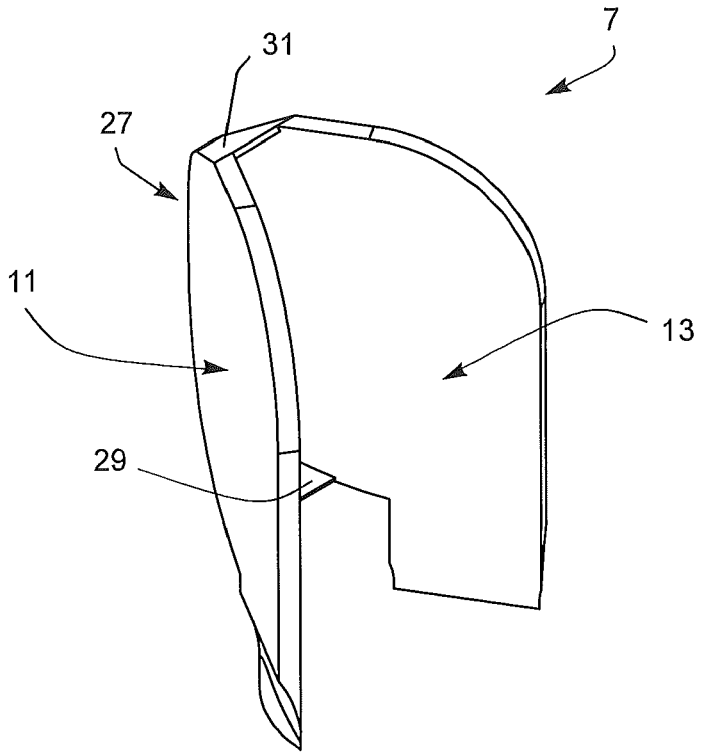
FIG. 5 is a perspective view of the pick.
Figure 6:
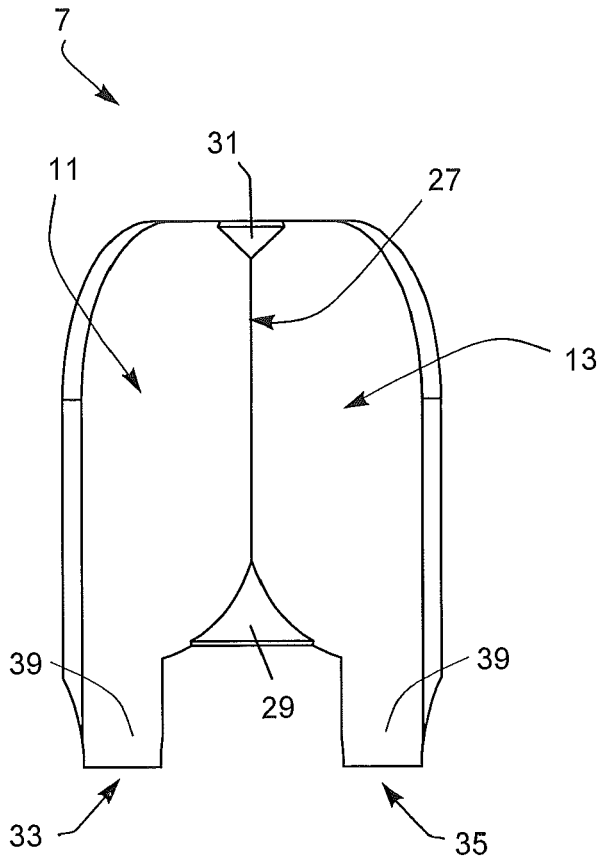
FIG. 6 is a front elevational view of FIG. 5.
Figure 7:
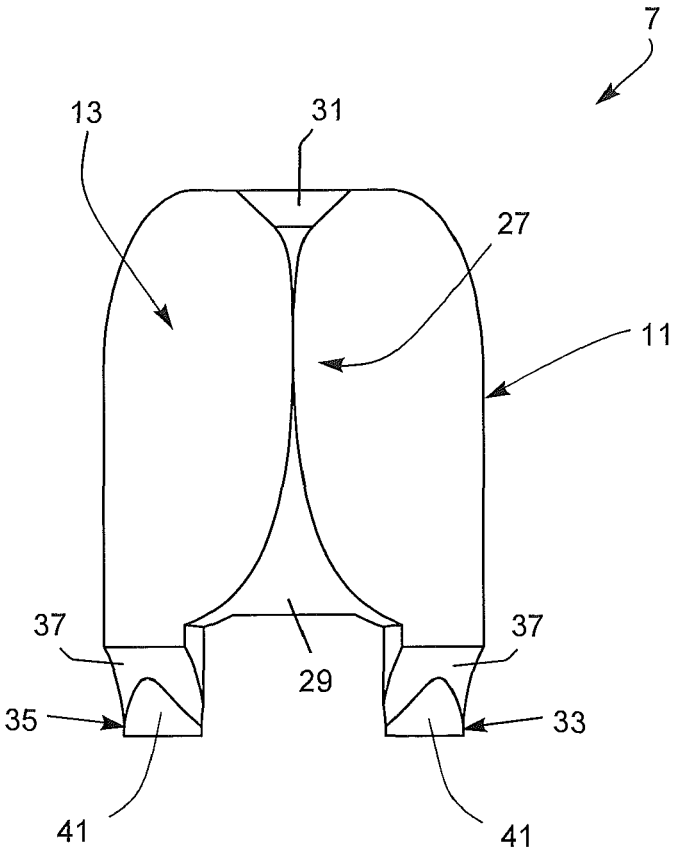
FIG. 7 is a rear elevational view of FIG. 5.
Figure 8:
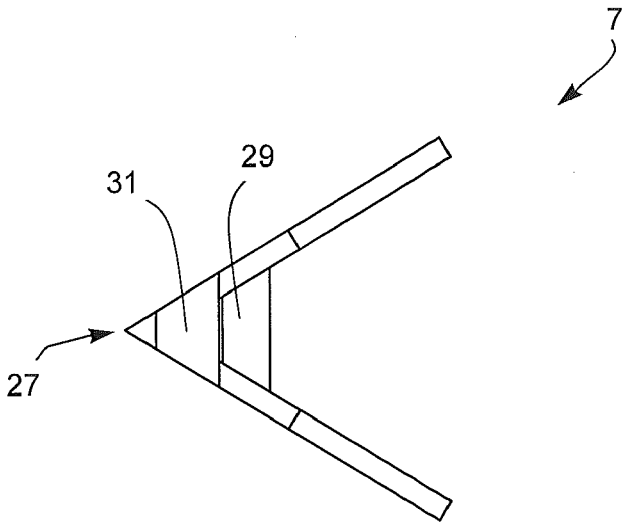
FIG. 8 is a top plan view of FIG. 5.
Figure 9:
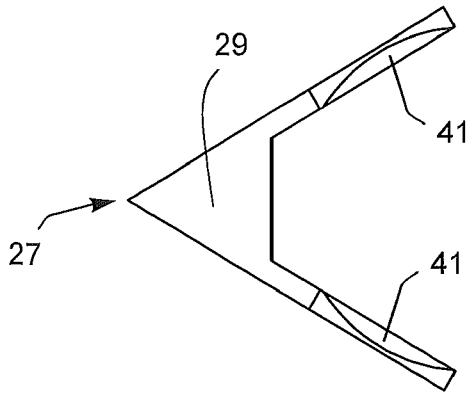
FIG. 9 is a bottom plan view of FIG. 5.
Figure 10:
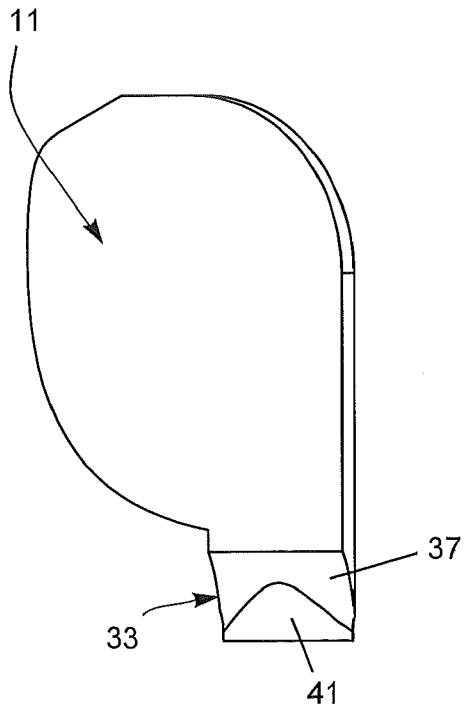
FIG. 10 is a right-side elevational view of FIG. 5.
Figure 11:
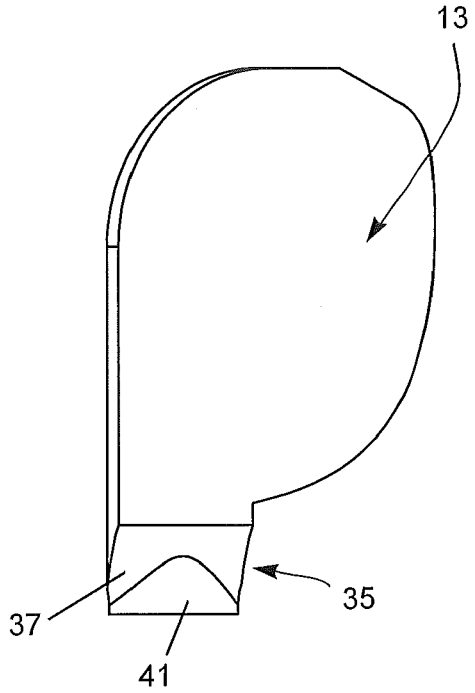
FIG. 11 is a left-side elevational view of FIG. 5.
Figure 12:
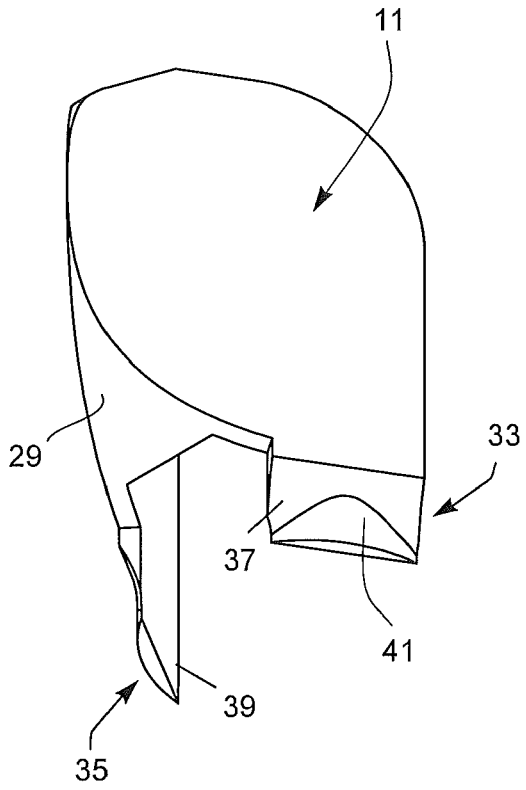
FIG. 12 is a bottom perspective view of FIG. 5.

The stringed instrument pick 1 includes a pick member 7 and a holding device 9 as shown in FIGS. 2-4. The two-piece configuration of the pick 1 allows users to pick and choose between picks of varying sizes, materials, and angles, thus allowing a user to utilize a number of different pick designs on a single holding device as will be hereinafter further explained. This also allows a user to choose between the varying shapes and sizes of pick member 7 to suit the user's playing style. This makes for a more versatile stringed instrument pick. The two-piece configuration further allows the user to select which finger or fingers he or she would like to use when playing a stringed instrument. The pick member 7 is the portion of the pick 1 used to strike or strum the guitar strings (or other instrument strings), and the holding device 9 affixes the pick 1 to a user's finger. The pick member 7 may be constructed of a variety of materials in order to provide a range of tones and sound effects. The pick member 7 may be constructed of metal, wood, plastic polymers, ceramic, and many other known or foreseeable materials.

The pick member 7 comprises two broad surfaces, a first playing surface 11 and a second playing surface 13. The playing surfaces 11, 13 each generally resemble traditional guitar picks. The first playing surface 11 and the second playing surface 13 each include an inner side edge 15. The inner side edge 15 of the playing surfaces 11, 13 includes a lower, portion 17 and an upper portion 19. The lower portion 17 is preferably substantially straight and is perpendicular to the holding device 9 as best illustrated in FIG. 3. The upper portion 19 is preferably rounded. In other embodiments, the playing surfaces 11, 13 may take on a variety of other shapes, so long as they abut to form the fine point, or edge, as described below.

The playing surfaces 11, 13 also include outer side edges 21 shown in FIG. 3 opposite from the inner side edges 15. Like the inner side edges 15, the outer side edges 21 include each of a lower portion 23 and an upper portion 25. However, the lower portions 23 of the outer side edges 21 are not perpendicular to the holding device 9 when the pick member 7 and the holding device 9 are releasably engaged with one another as best shown in FIG. 3.

The upper portions 25 of the outer side edges 21 of the playing surfaces 11, 13 intersect and abut one another to form a fine point, or joinder edge 27 as best shown in FIG. 4. When adjoined to one another, the surfaces 11, 13 form a V-shape, as viewed from above. The tip of the V-shape provides the fine point or joinder edge 27 used to pick or strum a stringed instrument. The V-shape allows a user to play his or her instrument faster and more comfortably by cutting down the distance between strings and providing broader playing surfaces compared to traditional picks. In the preferred embodiment, the angle between the first and second playing surfaces 11, 13 will vary between 20 and 80 degrees, allowing the user to choose an angle comfortable to his or her playing style. This customizability allows difficult songs with multiple picking sections to become easier and more comfortable to play.

FIGS. 5-12 illustrate the pick member 7 in greater detail. Below the fine point or joinder edge 27 where the first and second playing surfaces 11, 13 abut, a gap (not illustrated) is created between the surfaces 11, 13 where the surfaces 11, 13 separate from one another. This gap below the fine point or joinder edge 27, may include a third playing surface 29 as best illustrated in FIGS. 5-9, the playing surface 29 being positioned where the gap would otherwise exist. This third playing surface 29 is preferably flat and triangularly shaped. The third playing surface 29 may be useful when being used to play slide guitar, in addition to traditional guitar playing. A similar fourth surface 31 is provided above the fine point or joinder edge 27 where the surfaces 11, 13 abut. The surface 31 may also be used to play the guitar in experimental fashions. The fourth surface 31 is also preferably triangular in shape but it is also smaller than the third playing surface 29. The surfaces 29 and 31 likewise provide additional support and strength to the V-shaped configuration of the first and second surfaces 11, 13.

The pick member 7 also includes a first prong member 33 and a second prong member 35 that each protrude downwardly from the bottom of the pick member 7 as shown best in FIGS. 6, 7, and 10-12. The prong members 33, 35 extend downwardly from the first playing surface 11 and the second playing surface 13 respectively, and are positioned normal to the bottom surfaces of surfaces 11, 13 and in a substantially parallel fashion thereto. The prongs 33, 35 include each of an external surface 37 and an internal flat surface 39. The external surfaces 37 of each of the prongs 33, 35 includes a hook or clip 41, that project outwardly from the external surfaces 37. The clips 41 are tab-like components that allow the pick member 7 to be releasably attached to the holding device as will be hereinafter further explained.

Figure 13:
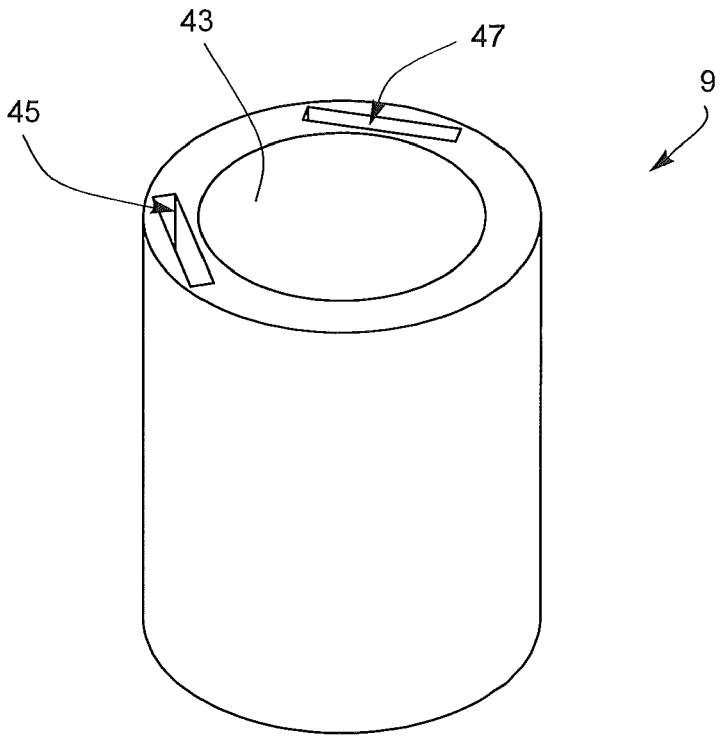
FIG. 13 is a perspective view of the holding device.
Figure 14:
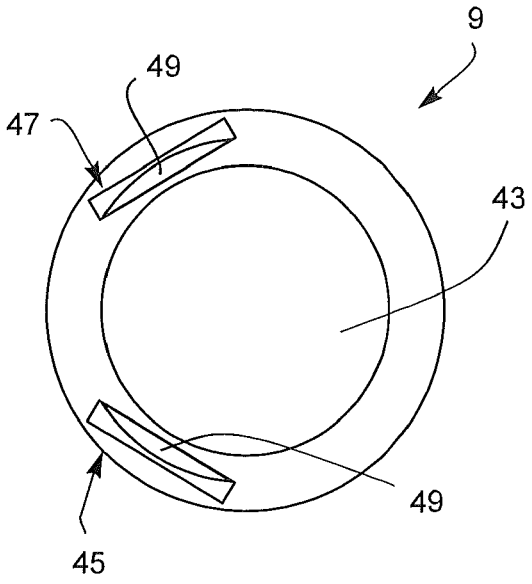
FIG. 14 is a top plan view of FIG. 13.

Turning now to FIGS. 13 and 14, the holding device 9 is preferably a cylindrical sleeve-like component that can fit over a user's finger. In alternative embodiments, the holding device 9 may take on other sizes and shapes so long as it is able to fit over a user's finger. The holding device 9 includes a finger hole 43, a first slot 45, and a second slot 47. The finger hole 43 is preferably concentrically located within the cylindrical holding device 9, thus creating a channel through which a user's finger may be inserted as shown in FIG. 1. The slots 45, 47 are cavities that extend vertically downwardly into the holding device 9 and are positioned normal to the top surface of the holding device 9. Each of the slots 45, 47 also preferably include clip grooves 49 that project inwardly toward the finger hole 43 for receiving and engaging the clips 41 associated with the first and second prongs 33 and 35 when inserted into the slots 45, 47. This allows the pick 7 to be engaged with the holding device 9.

Figure 15:
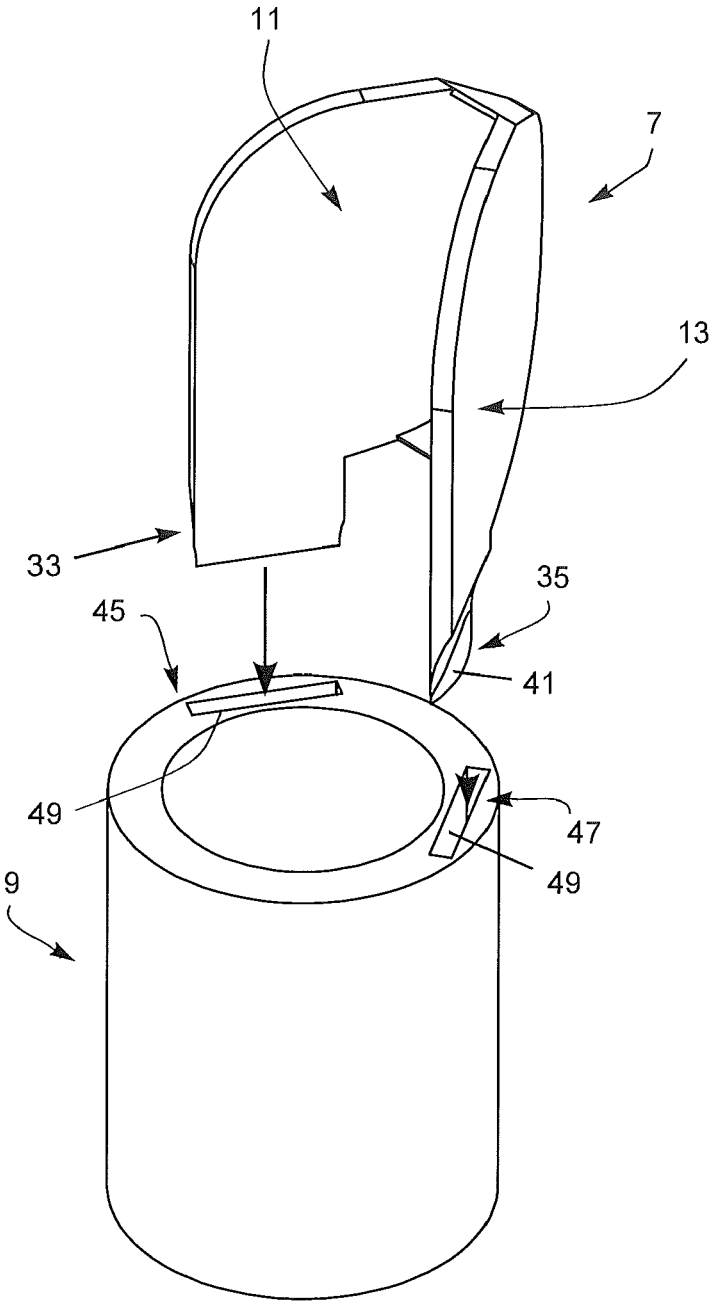
FIG. 15 is an exploded perspective view showing how the pick and the holding device are joined together.

The pick member 7 and the holding device 9 are selectively engageable such that if a user wants to use a differently angled (or sized) pick member with a particular holding device on a particular finger, he or she may do so. To engage the pick member 7 and the holding device 9 to one another, the first prong member 33 and the first slot 45 are aligned with one another, as shown in FIG. 15. Similarly, the second prong member 35 and the second slot 47 aligned with one another. The prong members 33, 35 are then pushed downwardly and received within the slots 45, 47, respectively. As the pick member 7 is pushed downwardly toward the holding device 9, the clips 41 on the prong members 33 and 35 eventually encounter the grooves 49 in the slots 45, 47. At that time, grooves 49 receive and engage the clips 41. The pick member 7 may be subsequently disengaged from the holding device 9 by squeezing the first and second playing surfaces 11 and 13 inwardly and pulling the pick member 7 vertically upwards.

Preferably, the holding device 9 is constructed of two different types of materials. At an upper portion, it is preferably constructed of a more rigid material such as plastic to minimize play, or movement, of the pick member 7 while the pick member 7 is in use. Meanwhile, a lower portion of the holding device 9 is preferably constructed of a more flexible material such as rubber or cloth to allow the holding device 9 to stretch and conform to the user's finger when worn.

Although the present pick member 7 and its corresponding holding device 9 are illustrated as having a specific shape in the above-referenced drawings, it is recognized and anticipated that members 7 and 9 can take on a wide variety of different shapes and surfaces, so long as the playing surfaces 11 and 13 can strike the strings associated with a particular stringed instrument. It is also recognized and anticipated that the shape and configuration of the holding device can likewise take on shapes other than a cylindrical shape so long as the finger hole 43 can receive a user's finger. The same is likewise true with respect to the shape and configuration of the various components associated with the pick member 7 and holding device 9 such as the prong members 33 and 35, the clips 41, the slots 45 and 47, and the various inner and outer surfaces associated with the playing surfaces 11 and 13 so long as these components and the members 7 and 9 are compatible with each other. All of these components can take on different shapes and configurations so long as the pick 1 can be utilized to play a particular stringed instrument.

It is also recognized that the grooves 49 associated with the slots 45 and 47 can likewise be shaped differently and can include merely a flat ledge or other surface for engaging the clips 41 associated with prong members 33 and 35. Still further, the joinder edge 27 can likewise be of any length so long as the two respective playing surfaces 11 and 13 are suitably joined together at such edge. In addition, the members 29 and 31 can likewise take on different shapes and configurations and any additional support members can be utilized to further support the joinder of the playing surfaces 11 and 13. It is also recognized and anticipated that other materials, other than those identified above, can likewise be utilized for fabricating the pick member 7 and the holding device 9.

As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A pick for playing stringed instruments, the pick comprising:

a holding device including a finger hole shaped to fit a user's finger;

a pick member selectively engageable with the holding device, the pick member including:

a first playing surface having an inner side edge and an outer side edge; and a second playing surface having an inner side edge and an outer side edge, wherein the outer side edge of the first playing surface and the outer side edge of the second playing surface abut and adjoin one another along at least a portion thereof to form a joinder edge between said respective outer side edges whereby the first and second playing surfaces are joined in a sideby-side relationship to each other.

2. The pick of claim 1 wherein the pick member includes a third playing surface positioned and located below the joinder edge, the third playing surface being attached to the first and second playing surfaces respectively.

3. The pick of claim 2 wherein the third playing surface is flat and triangularly shaped.

4. The pick of claim 1 wherein the pick member includes a first prong member and a second prong member extending downwardly from the pick member, the first and second prong members being selectively engageable with the holding device.

5. The pick of claim 4 wherein the holding device includes a first slot and a second slot, the first slot and the second slot being positioned and located so as to selectively receive and engage the first and second prong members respectively.

6. The pick of claim 1 wherein the pick member is made of at least one of metal, wood, plastic polymers, and ceramic.

7. The pick of claim 1 wherein the holding device includes an upper portion and a lower portion, the upper portion being constructed of a rigid material.

8. The pick of claim 1 wherein the holding device includes an upper portion and a lower portion, the lower portion being constructed of a flexible material.

9. The pick of claim 5 wherein the first and second prong members each include a clip that projects outwardly from the respective prong member.

10. The pick of claim 9 wherein the first slot and the second slot each include a groove that projects inwardly toward the finger hole, the clips of the first and second prong member being selectively engageable with the grooves of the first and second slots respectively.

11. The pick of claim 1 wherein the first and second playing surfaces form a V-shape configuration.

12. A pick for playing stringed instruments, the pick comprising:

a holding device having upper and lower portions and including:

a finger hole shaped to fit a user's finger; and a first slot and a second slot associated with its upper portion;

a pick member selectively engageable with the holding device, the pick member including:

a first playing surface having an inner side edge and an outer side edge;

a second playing surface having an inner side edge and an outer side edge, wherein the outer side edge of the first playing surface and the outer side edge of the second playing abut and adjoin one another along a joinder edge to form a V-shaped configuration; and a first prong member and a second prong member extending downwardly from the pick member;

the first and second prong members being positioned and located so as to selectively engage the first and second slots of the holding device respectively.

13. The pick of claim 12 wherein the pick member includes a third playing surface positioned and located below the joinder edge, the third playing surface being attached to the first and second playing surfaces respectively.

14. The pick of claim 13 wherein the third playing surface is flat and triangularly shaped.

15. The pick of claim 12 wherein the pick member is made of at least one of metal, wood, plastic polymers, and ceramic.

16. The pick of claim 12 wherein the holding device includes an upper portion and a lower portion, the upper portion being constructed of a rigid material and the lower portion being constructed of a flexible material.

17. The pick of claim 12 wherein the first and second prong members each include a clip that projects outwardly from the respective prong member.

18. The pick of claim 17 wherein the first and second slots each include a groove that projects inwardly toward the finger hole, the clips of the first and second prong members being selectively engageable with the grooves of the first and second slots respectively.

19. The pick of claim 12 wherein the holding device is cylindrical in shape.

20. The pick of claim 12 wherein the angle between the first playing surface and the second playing surface is between 20 and 80 degrees.

21. A pick for playing stringed instruments, the pick comprising:

a holding device including a finger hold shaped to fit a user's finger;

a pick member selectively engageable with the holding device, the pick member including:

a first playing surface having an inner side edge and an outer side edge;

a second playing surface having an inner side edge and an outer side edge, wherein the outer side edge of the first playing surface and the outer side edge of the second playing surface abut and adjoin one another along at least a portion thereof to form a joinder edge therebetween; and a third playing surface positioned and located below the joinder edge, the third playing surface being attached to the first and second playing surfaces respectively.

22. The pick of claim 21 wherein the holding device includes an upper portion and a lower portion, the upper portion being constructed of a rigid material and the lower portion being constructed of a flexible material.

* * * * *